US007044898B2

(12) United States Patent
Kuo et al.

(10) Patent No.: US 7,044,898 B2
(45) Date of Patent: May 16, 2006

(54) STRETCHING EXERCISER

(76) Inventors: Johnson Kuo, 11F-1C, No. 342, Keelung Rd., Sec. 1, Taipei (TW); Chin-Lien Huang, 2F, No. 14, Ning Hsia E. 5 St., Taichung (TW)

( * ) Notice: Subject to any disclaimer, the term of this patent is extended or adjusted under 35 U.S.C. 154(b) by 425 days.

(21) Appl. No.: 10/651,106

(22) Filed: Aug. 29, 2003

(65) Prior Publication Data

US 2004/0038786 A1 Feb. 26, 2004

(51) Int. Cl.
*A63B 21/04* (2006.01)
*A63B 21/055* (2006.01)

(52) U.S. Cl. ..... 482/121; 482/123; 482/126; 482/130; 482/138; 482/145; 482/907

(58) Field of Classification Search ..... 482/72, 482/73, 95, 96, 121–123, 125, 126, 129, 482/130, 137, 138, 142, 145, 907
See application file for complete search history.

(56) References Cited

U.S. PATENT DOCUMENTS 5,393,286 A * 2/1995 Cheng ..... 482/130
5,527,243 A * 6/1996 Chen ..... 482/72
5,533,953 A * 7/1996 Lui et al. ..... 482/96
5,599,261 A * 2/1997 Easley et al. ..... 482/130
5,616,105 A * 4/1997 Wang et al. ..... 482/72
5,833,590 A * 11/1998 Chiu et al. ..... 482/142
6,152,866 A * 11/2000 Kuo ..... 482/142
6,533,710 B1 * 3/2003 Lin et al. ..... 482/123
D491,618 S * 6/2004 Kuo et al. ..... D21/676
6,793,610 B1 * 9/2004 Deola ..... 482/130
2002/0173412 A1 * 11/2002 Stearns ..... 482/123

* cited by examiner

*Primary Examiner*—Stephen K. Cronin
*Assistant Examiner*—Victor K. Hwang
(74) *Attorney, Agent, or Firm*—Browdy and Neimark, PLLC

(57) ABSTRACT

A stretching exerciser includes a seat bar supported on a collapsible spring bar at a base in a backwardly tilted position. A back cushion is pivotally fastened with a top end of the seat bar and forwardly backwardly turnable relative to the seat bar. The back cushion is closely attached to the seat bar due to the effect of the gravity weight when receiving no external force. A seat is pivoted to the seat bar. An axle is adjustably mounted on a front side of seat bar to selectively support the seat between two elevational positions.

10 Claims, 5 Drawing Sheets

STRETCHING EXERCISER

BACKGROUND OF THE INVENTION

1. Field of the Invention

The present invention relates generally to an exercising machine and, more specifically, to a stretching exerciser.

2. Description of the Related Art

A conventional stretching exerciser is known comprising a base, a leg extension bar located on the base, an upright extended upwardly backwards from the base, and a back cushion fixedly located on the top end of the upright. When in use, the user hook the legs on the leg extension bar and rest the back on the back cushion, and then alternatively bending the body backwardly downwards and lifting the head and the upper part of the body.

This design of stretching exerciser is not satisfactory in function. When the user is curving the body to stretch the muscles, the back cushion is not curved with the user's body to positively support the user's back, and the user's body may feel uncomfortable. Further, this design of stretching exercise can simply exercise the muscles of the user's back and abdomen. It is not practical to exercise the muscles of the other part of the body.

SUMMARY OF THE INVENTION

The present invention has been accomplished under the circumstances in view. It is the main object of the present invention to provide a stretching exerciser, which is safe and comfortable in use.

It is another object of the present invention to provide a stretching exerciser, which provides various operation modes for enabling the user to exercise the muscles of the whole body.

To achieve these objects of the present invention, the stretching exerciser comprises a base for positioning on the floor; a seat bar having a bottom end pivoted to the base and a top end; a back cushion fastened pivotally with the top end of the seat bar and forwardly backwardly turnable relative to the seat bar, the back cushion being closely attached to the seat bar due to the effect of the gravity weight thereof when receiving no external force; a seat mounted on the seat bar below the back cushion; and a spring bar for supporting the seat bar on the base in a backwardly tilted position, the spring bar having a bottom end coupled to the base and a top end coupled to the seat bar.

DETAILED DESCRIPTION OF THE INVENTION

Figure 1:
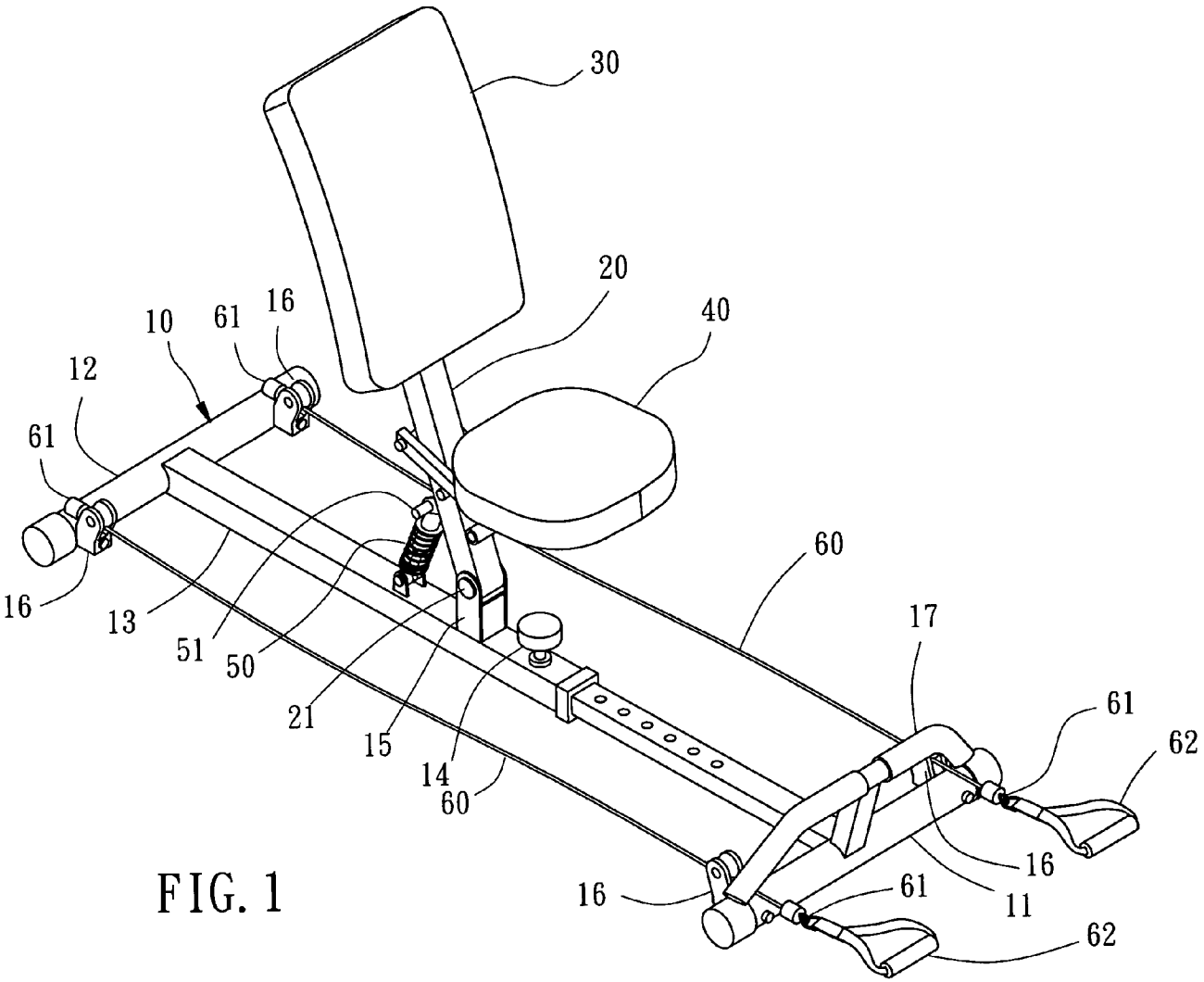
FIG. 1 is a perspective view of a stretching exerciser according to the present invention.
Figure 2:
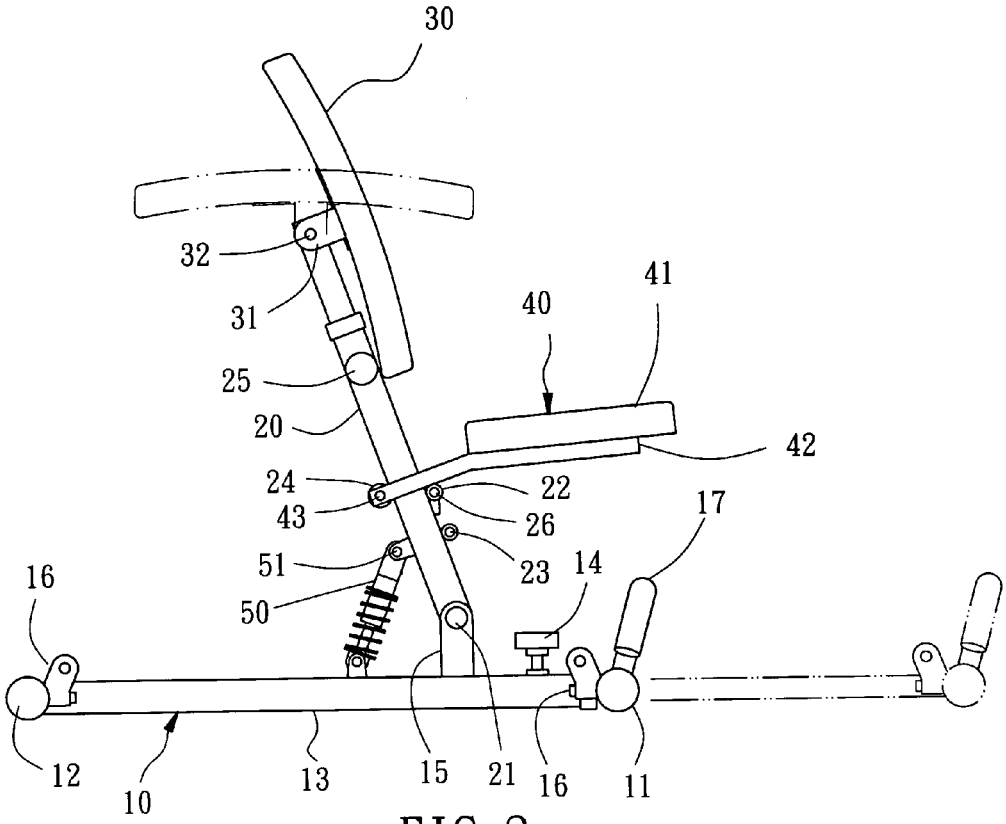
FIG. 2 is a schematic side view of the present invention, showing the adjustment of the positions of the back cushion and the base.

Referring to FIGS. 1 and 2, a stretching exerciser in accordance with the present invention is shown comprised of a base 10, a seat bar 20, a back cushion 30, a seat 40, a spring bar 50, and two elastic cord members 60.

The base 10 is a substantially I-shaped framework comprising a front transverse bar 11, a rear transverse bar 12, and a longitudinal bar 13 connected between the front transverse bar 11 and the rear transverse bar 12. According to the present preferred embodiment, the longitudinal bar 13 is a retractable rectangular bar so arranged that the front transverse bar 11 can be moved forwards/backwards relative to the rear transverse bar 12 (see the imaginary line shown in FIG. 2) and then locked by a lock screw 14 at the retractable longitudinal bar 13. An upright lug 15 is located on the longitudinal bar 13 at the top. Pulleys 16 are respectively provided at the ends of the front and rear transverse bars 11 and 12. A leg extension bar 17 is provided at the front transverse bar 11.

The seat bar 20 according to the present preferred embodiment is a retractable rectangular bar provided with a lock screw 25 at the right side for locking the seat bar 20 at the desired length. A pivot 21 is transversely extended through the bottom end of the seat bar 20 to pivotally secure the seat bar 20 to the upright lug 15, for enabling the seat bar 20 to be turned back and forth relative to the base 10. A first barrel 22 and a second barrel 23 are fixedly horizontally provided at the front side of the seat bar 20 at different elevations. An axle 26 is selectively and detachably inserted through the first barrel 22 or the second barrel 23. A third barrel 24 is fixedly horizontally provided at the back side of the seat bar 20 above the elevation of the first barrel 22, which is spaced above the second barrel 23.

The back cushion 30 is a rectangular pad of soft material, having a back frame 31 pivotally fastened to the top end of the seat bar 20 with a pivot 32. Therefore, the back cushion 30 can be turned relative to the seat bar 20 between a substantially vertical position (see the solid line shown in FIG. 2) and a substantially horizontal position above the top end of the seat bar 20 (see the imaginary line shown in FIG. 2). Due to the effect of the gravity weight, the back cushion 30 is normally supported on the seat bar 20 in the substantially vertical position.

The seat 40 comprises a seat pad 41 and two parallel seat frame bars 42 fixedly provided at the bottom side of the seat pad 41. The rear ends of the seat frame bars 42 protrude over the rear side of the seat pad 41 and respectively pivotally connected to the two ends of the third barrel 24 by a pivot pin 43, keeping the seat pad 41 at the front side of the seat bar 20 for sitting. The axle 26 is selectively and detachably inserted through the first barrel 22 or the second barrel 23 to support the seat frame bars 42 between two positions.

The spring bar 50 is adapted to support the seat bar 20 in a backwardly tilted position, having a bottom end fastened pivotally with the longitudinal bar 13 of the base 10 and a top end detachably pivotally fastened to the back side of the seat bar 20 by a lock pin 51.

The two elastic cord members 60 are longitudinally provided at two sides of the base 10 and respectively extended through the pulleys 16, each having two end pieces 61 at the respective two distal ends. Two loop handles 62 are respectively and detachably fastened to the front ends or rear ends of the elastic cord members 60 for the holding of the user's hands or the hooking of the user's legs.

Before use, the retractable longitudinal bar 13 and the retractable seat bar 20 are respectively adjusted to the desired length and then locked, so that the user can hook the legs on the leg extension bar 17 and rest the back on the back cushion 30 comfortably. When in use, the user can exercise the body in one of a variety of operation modes as outlined hereinafter.

Figure 4:
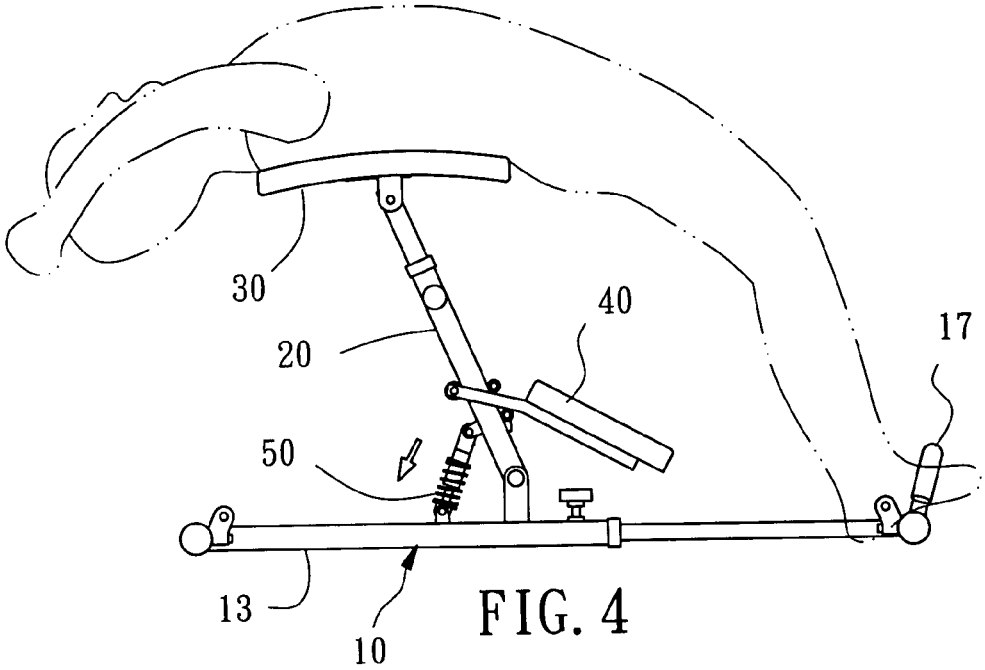
FIG. 4 is a schematic drawing showing one application example of the present invention.

1. As shown in FIG. 4, the user can rest the back on the back cushion 30 and hook the legs on the foot extension bar 17, and then alternatively stretch and release the body to exercise the muscles of the back and the abdomen.

Figure 5:
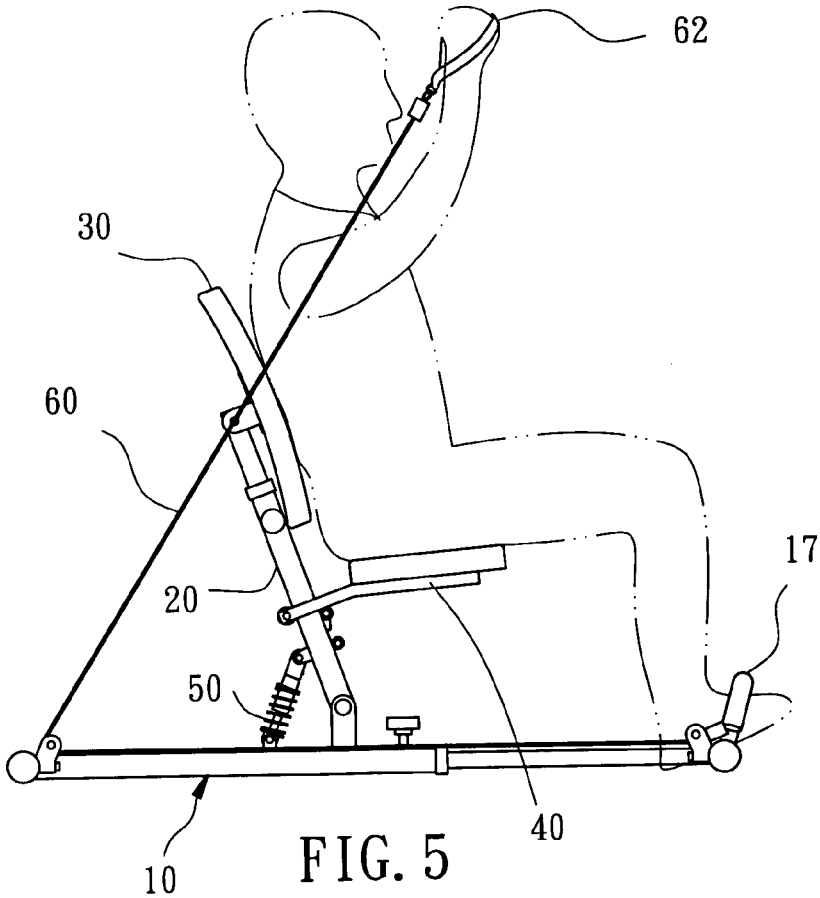
FIG. 5 is a schematic drawing showing another application example of the present invention.

2. As shown in FIG. 5, the user can sit on the seat 40, hook the legs on the leg extension bar 17, and hold the loop handles 62 with the hands after the loop handles 62 have been respectively fastened to the end pieces at the rear ends of the elastic cord members 60, and then pull the loop handles 62 forwardly upwards to stretch the elastic cord members 60, so as to exercise the muscles of the shoulders and the arms.

Figure 6:
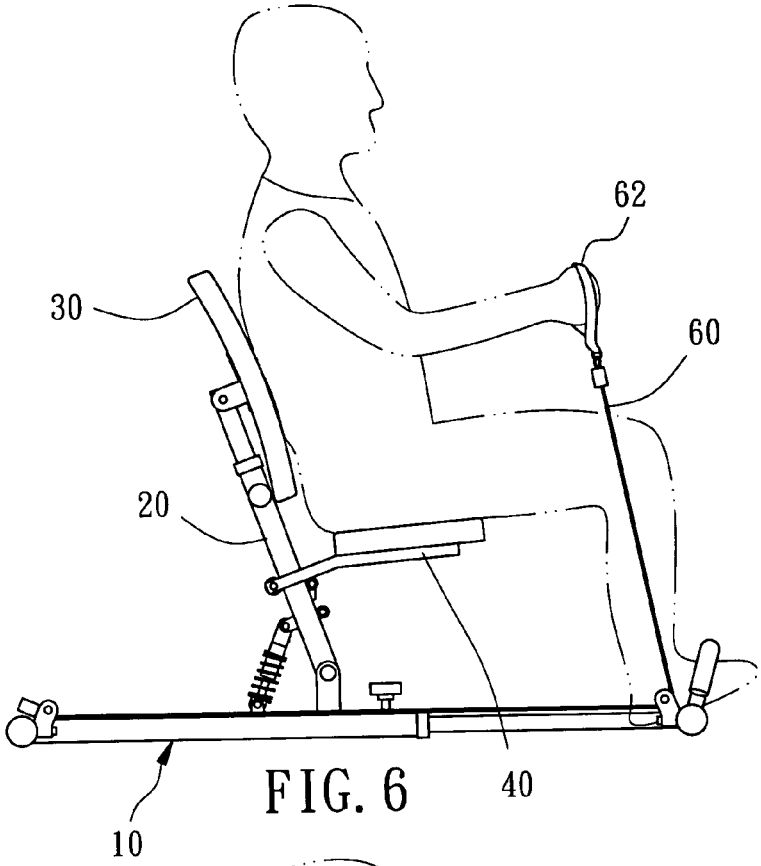
FIG. 6 is a schematic drawing showing still another application example of the present invention.

3. As shown in FIG. 6, the user can sit on the seat 40 and hold the loop handles 62 with the hands after the loop handles 62 have been respectively fastened to the end pieces at the front ends of the elastic cord members 60, and then pull the loop handles 62 upwards to stretch the elastic cord members 60, so as to further exercise the muscles of the shoulders and the arms.

Figure 7:
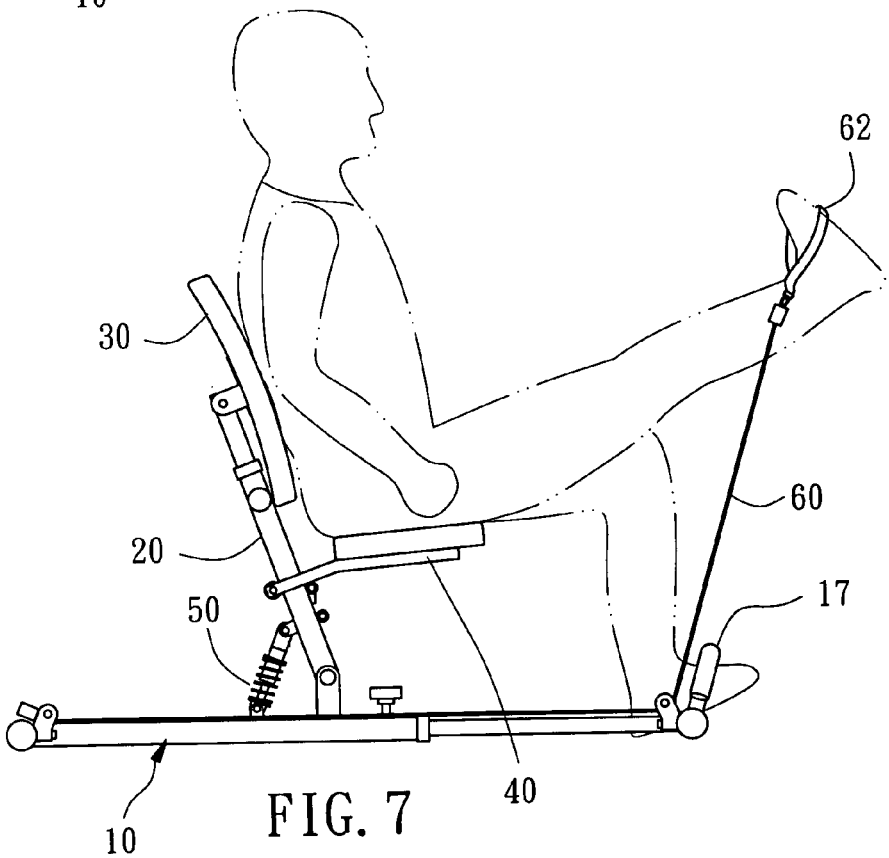
FIG. 7 is a schematic drawing showing still another application example of the present invention.

4. As shown in FIG. 7, the user can sit on the seat 40 and hook the legs on the loop handles 62 after the loop handles 62 have been respectively fastened to the end pieces at the front ends of the elastic cord members 60, and then alternatively lift the legs to stretch the elastic cord members 60, so as to further exercise the muscles of the legs.

Figure 8:
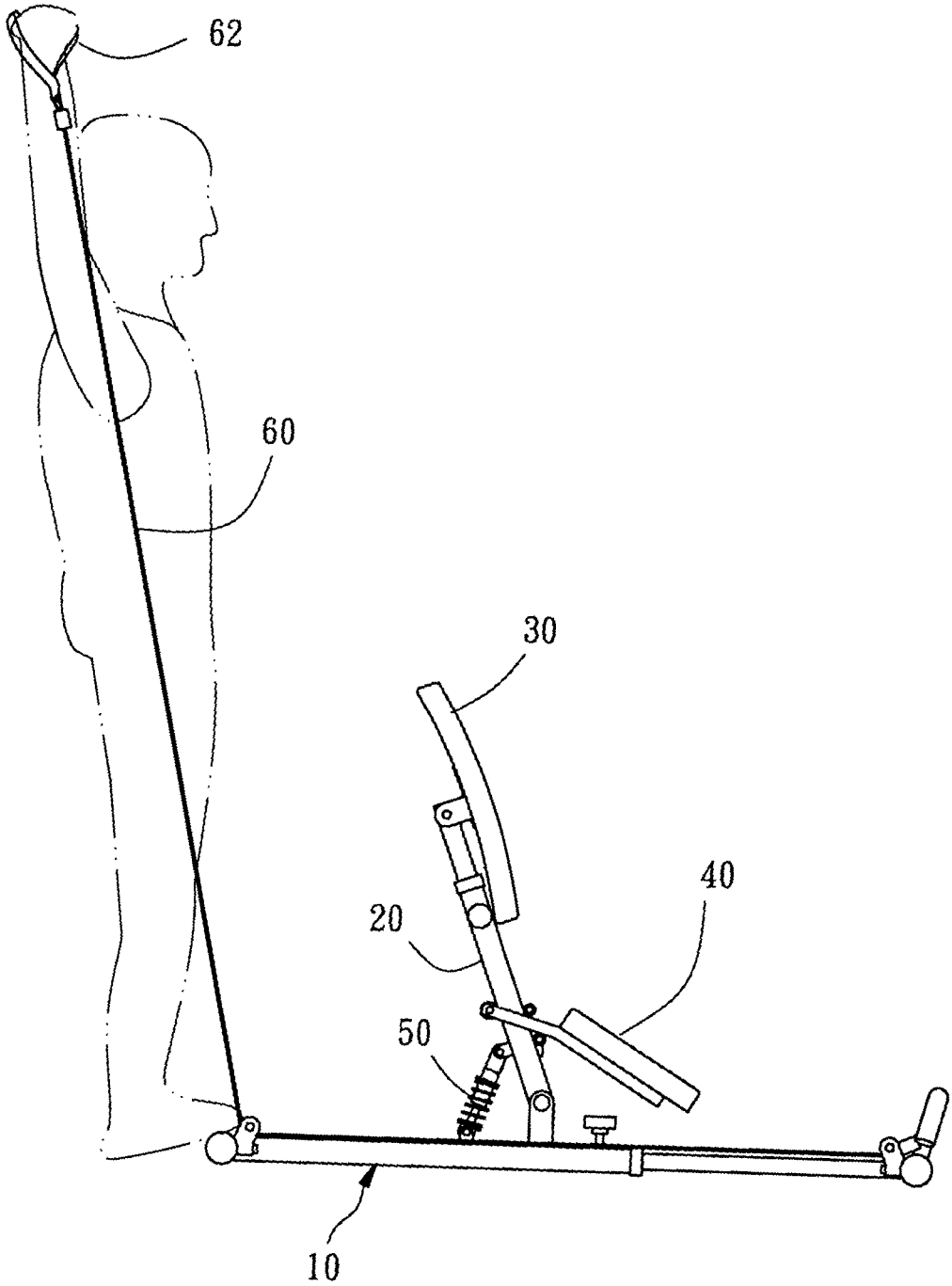
FIG. 8 is a schematic drawing showing still another application example of the present invention.

5. As shown in FIG. 8, the user can stand on the rear transverse bar 12 of the base 10 and then pull the loop handles 62 upwards to stretch the elastic cord members 60 after the loop handles 62 have been respectively fastened to the end pieces at the rear ends of the elastic cord members 60, so as to further exercise the muscles of the arms.

6. The user can also rest the back on the back cushion 30, hook the legs on the leg extension bar 17, and hold the loop handles 60 with the hands after the loop handles 62 have been respectively fastened to the end pieces at the rear ends of the elastic cord members 60, and then simultaneously or alternatively lift the loop handles 62 to stretch the elastic cord members 60 when alternatively stretching and releasing the body, so as to exercise the muscles of the arms, the back, and the abdomen.

Further, the user can also rest the abdomen on the back cushion 30 and hold the leg extension bar 17 with the hands, and then perform push-and-pull to exercise the muscles of the arms and the chest.

Figure 3:
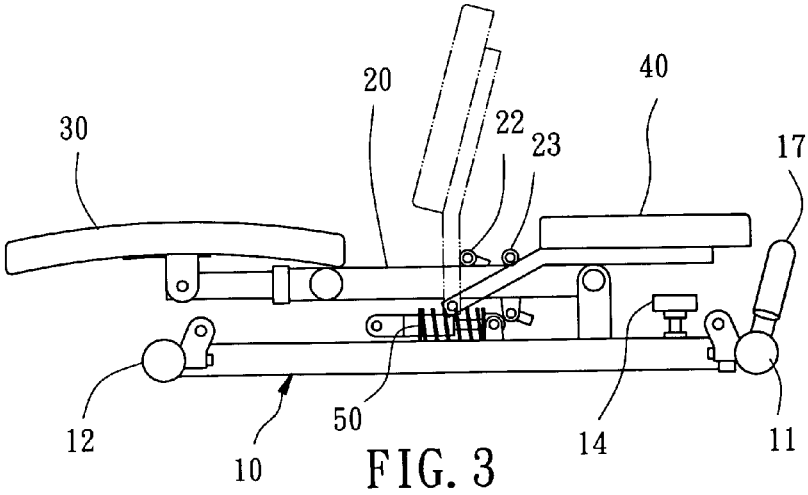
FIG. 3 is another schematic side view of the present invention, showing the receiving operation of the stretching exerciser.

When not in use, as shown in FIG. 3, the lock pin 51 is removed from the spring bar 50 and the seat bar 20, and then the spring bar 50 and the seat bar 20 are turned downwards toward the base 10 to a received position in parallel to the base 10, and then remove the axle 26 from the seat bar 20 for enabling the seat 40 to be turned to the received position in parallel to the collapsed seat bar 20.

While only one embodiment of the invention has been shown and described, it will be understood that various modifications and changes could be made thereunto without departing from the spirit and scope of the invention. Accordingly, the invention is not to be limited except as by the appended claims.

What is claimed is:

1. A stretching exerciser comprising:

a base for positioning on a floor;

a seat bar having a bottom end pivoted to said base and a top end;

a back cushion fastened pivotally with the top end of said seat bar and forwardly backwardly turnable relative to said seat bar, said back cushion being closely attached to said seat bar due to the effect of the gravity weight thereof when receiving no external force;

a seat mounted on said seat bar below said back cushion; and a spring bar for supporting said seat bar on said base in a backwardly tilted position, said spring bar having a bottom end coupled to said base and a top end coupled to said seat bar.

2. The stretching exerciser as claimed in claim 1, further comprising two elastic cord members provided at two sides of said base, said elastic cord members each having one end provided with handle means for the holding of the user's hands or hooking of the user's legs to stretch said elastic cord members.

3. The stretching exerciser as claimed in claim 2, wherein said base comprises two pairs of pulleys symmetrically disposed at front and rear sides thereof; said elastic cord members are respectively extended through said pulleys.

4. The stretching exerciser as claimed in claim 1, wherein said base comprises a front transverse bar, a rear transverse bar, and a longitudinal bar connected between said front transverse bar and said rear transverse bar; the bottom end of said seat bar is pivoted to said longitudinal bar.

5. The stretching exerciser as claimed in claim 4, wherein said longitudinal bar is a retractable bar connected between said front transverse bar and said rear transverse bar for enabling said front transverse bar to be moved forwards and backwards relative to said rear transverse bar, said longitudinal bar having a lock screw for locking said front transverse bar in position.

6. The stretching exerciser as claimed in claim 1, wherein said base comprises a leg extension bar at a front side thereof for the hooking of the user's legs.

7. The stretching exerciser as claimed in claim 1, wherein said seat bar is a retractable bar having a fixed end pivoted to said base and a movable end pivoted to said back cushion.

8. The stretching exerciser as claimed in claim 1, wherein said seat comprises a seat pad and two parallel seat frame bars fixedly provided at a bottom side of said seat pad, said sear frame bars each having a rear end protruding over a rear side of said seat pad and bilaterally pivoted to a back side of said seat bar; said seat bar has a front side provided with a horizontally extended detachable axle for supporting said seat frame bars of said seat in a position not parallel to said seat bar.

9. The stretching exerciser as claimed in claim 8, wherein said seat bar comprises two horizontal barrels disposed at the front side thereof at different elevations; said axle is selectively mounted in one of said horizontal barrels.

10. The stretching exerciser as claimed in claim 1, wherein said spring bar has the bottom end pivoted to said base and the top end detachably pivoted to said seat bar such that when the top end of said spring bar is disconnected from said seat bar, said spring bar and said seat bar can be turned downward and closely attached to said base in horizontal.

* * * * *